United States Patent [19]

Kurz

[11] Patent Number: 4,724,414

[45] Date of Patent: Feb. 9, 1988

[54] ELECTRICAL SWITCH DEVICE

[75] Inventor: Manfred Kurz, Ditzingen, Fed. Rep. of Germany

[73] Assignee: Behr-Thomson Dehnstoffregler GmbH, Kornwestheim, Fed. Rep. of Germany

[21] Appl. No.: 926,577

[22] Filed: Nov. 4, 1986

[30] Foreign Application Priority Data

Nov. 14, 1985 [DE] Fed. Rep. of Germany ..... 3540458

[51] Int. Cl.[4] ..... H01H 37/46

[52] U.S. Cl. ..... 337/383; 337/310

[58] Field of Search ..... 337/383, 397, 311, 310, 337/309, 396, 412; 200/81.4, 67 B, 67 D; 60/526

[56] References Cited

U.S. PATENT DOCUMENTS 4,374,373 2/1983 Kurz ..... 337/383

*Primary Examiner*—Harold Broome

*Attorney, Agent, or Firm*—Barnes & Thornburg

[57] ABSTRACT

In an electrical switchgear having a common housing for a thermostatic expansion material element and at least two electrical snap switches that can be actuated by a working piston of the expansion material element, the snap switches are electrically separated from one another and each have their own rocker for switching the snap switches in response to displacement of the working piston. The switching rockers move in parallel paths and are arranged to at least one side of the longitudinal center of the working piston.

13 Claims, 2 Drawing Figures

ELECTRICAL SWITCH DEVICE

BACKGROUND AND SUMMARY OF THE INVENTION

The present invention relates to an electrical switchgear having a common housing for a thermostatic expansion material element and at least two electrical snap switches that can be actuated by a working piston of the expansion material element. The snap switches contain a switching tongue that can be swivelled between two switching positions and to which a switching spring is applied, the other end of the spring being coupled to a switching rocker that is swivelled by the working piston and is disposed on a holding plate.

An example of switchgear of the above-described type is shown in U.S. Pat. No. 4,374,373 having two snap switches that are equipped with their own switching tongues and their own switching springs. The switching tongues of the snap switches are supported at a joint holding plate on which a switching rocker is also disposed. Both snap switches have this switching rocker in common, the two switching springs being coupled to the switching rocker. This known switchgear allows two independent switching operations that can be carried out at different temperature stages. The advantage of the known construction is that only a low overall size is required and that for both snap switches, several components can be used jointly, particularly the switching rocker and the corresponding holding plate.

An objective of the present invention is to provide an electrical switchgear of the initially described type which provides switching of two electrically separate switching circuits that are completely independent from one another without significantly increasing construction costs.

This and other objectives are achieved in the present invention by providing an electrical switchgear of the initially described type with electrically separate snap switches having rockers moved by the displacement of the working piston. The rockers move in the housing in parallel moving paths, the paths being arranged to at least one side of the longitudinal center of the working piston.

In the present invention, a complete electrical separation is obtained between the snap switches, and the required additional expenditures are kept low. In particular, these additional expenditures are significantly less than the conventional solutions in which for the switching of two electrically separate switching circuits two electrical switchgears were used with one snap switch respectively.

In order to meet the requirements of an installation space that is as small as possible, it is provided in a preferred embodiment switching rockers which are constructed asymmetrically and have support surfaces assigned to the working piston. The support surfaces are arranged more closely to the longitudinal center line of the working piston than the receiving means with which they are disposed on the holding plate. The result is that an unnecessarily large working piston is not required to actuate the two switching rockers.

In a further feature of a preferred embodiment of the invention, the snap switches are arranged rotated with respect to one another by 180° such that the switching rockers will move in opposite directions. Snap switches arranged this way require very little installation space. A further feature of a preferred embodiment are switches that are constructed of identically designed elements. The switching rockers, despite their asymmetrical shape, are able to have identical construction because of the rotated arrangement of the snap switches.

In a preferred embodiment, the two snap switches switch in the same position of the working piston, in other words, at the same switching temperature. However, it is contemplated to have the switching operations carried out at different temperatures. For this purpose, in a further preferred embodiment of the invention the switching tongues and/or the switching rockers and/or the coupling points for the switching springs of the two snap switches are different from one another and/or are arranged to deviate from one another. In order not to give up the advantage of having the same structural elements, it is sufficient if the individual elements are only slightly plastically bent or arranged at different heights with respect to the working piston in order to obtain the desired different switching times or switching temperatures.

Further objects, features, and advantages of the present invention will become more apparent from the following description when taken with the accompanying drawings which show, for purposes of illustration only, an embodiment in accordance with the present invention.

DETAILED DESCRIPTION OF THE DRAWINGS

Figure 1:
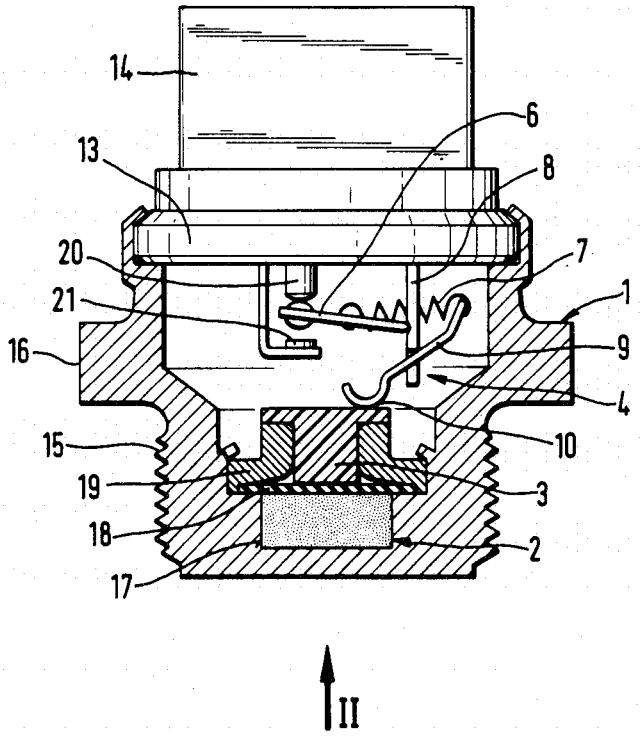
FIG. 1 is a partial sectional view through an electrical switchgear constructed in accordance with a preferred embodiment of the present invention.

The electrical switchgear shown in FIG. 1 has a metallic housing 1 in which a thermostatic working element 2 is housed. The open side of the metallic housing 1 is closed off by an insulating plate 13, at the interior side of which two electrical snap switches 4 and 5 are arranged. The insulating plate, that in preferred embodiments is made of plastic, is equipped with a tube-shaped, preferably rectangular projection 14 in which contact vanes are housed that, in a way not shown in detail, are in pairs assigned to the snap switches 4 and 5.

The bottom of the housing 1 is equipped with an external thread 15 and with a tool working surface 16, preferably a hexagon. Inside the bottom of the housing 1 is a recess 17 that is filled with an expansion material, preferably a wax mixture. The recess 17 is closed off by an elastic membrane 18 that, by means of a guiding insertion 19, is clamped fast against a shoulder of the housing 1. The guiding insertion 19 is equipped with a centric bore in which a working piston 3 is guided that is preferably made of plastic and that, in the shown inoperative position, has a head which rests against the upper edge of the guiding insertion 19. When the expansion material contained in the recess 17 is expanded due to heating, the working piston 3 is moved on a predetermined path to switch the two snap switches 4 and 5.

For reasons of clarity, only the snap switch 4 is shown in FIG. 1. The two snap switches 4 and 5 are developed identically, as shown especially in FIG. 2. They are arranged to be staggered with respect to the longitudinal center line of the working piston 3 and thus also to the center of the housing 1. The snap switches 4 and 5 are rotated by 180° with respect to one another, and each have a switching tongue 6 that with one end is supported at a holding plate 8 and which can be swivelled back and forth between two switching positions. One of the switching positions is determined by a break contact 20 that is embedded into the insulating plate 13, and the other one is determined by a make contact 21. The holding plate 8 and the make contact 21, in a way not shown in detail, are guided through the insulating plate 13 and in the projection 14 form contact vanes which are assigned to one another.

A switching spring 7 is coupled to the U-shaped switching tongue 6 that supports itself with both legs at the holding plate 8. The switching spring 7 is guided through the holding plate 8 and is suspended to a switching rocker 9. This switching rocker 9 is equipped with a recess or receiving means 11 with which it is fitted onto a projection (not shown) of the holding plate 8 that is limited by a shoulder. The projection and the shoulder of the holding plate 8 form a hinge for the switching rocker 9. The switching rocker 9 is equipped with a supporting surface 10 by means of which it rests on the working piston 3.

When the expansion material is expanded, the working piston 3 is moved upwardly as seen in FIG. 1, so that the switching rocker 9 is swivelled. The supporting surface 10 slides transversely on the top side of the working piston 3. Because of the swivelling of the switching rocker 9, the acting direction of the switching spring 7 will change after the dead center is passed such that starting from an indicating position of the working piston 3 and thus of the switching rocker 9, the switching tongue 6 snaps and with its contact comes to rest at the make contact 21. The electrically conducting connection between the holding plate 8 and the make contact 21 and thus between their corresponding contact vanes is then closed.

In the case of a cooling, the volume expansion material contained in the recess 17 is reduced, so that the working piston 3, by means of the correspondingly designed switching springs 7 of the two snap switches 4 and 5, is moved back into its starting position.

Figure 2:
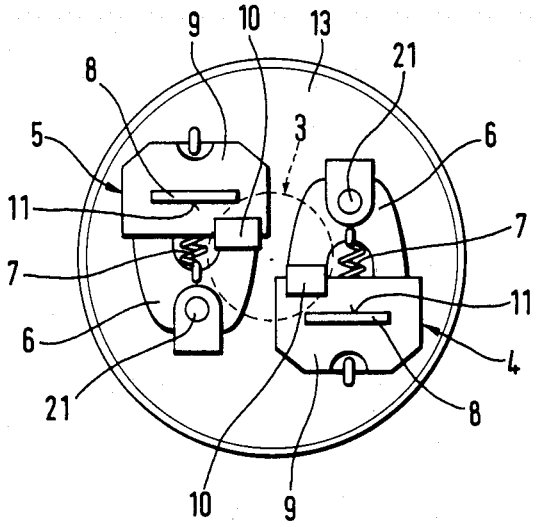
FIG. 2 is a partial view in the direction of Arrow II of the snap switch of the switchgear according to the embodiment of FIG. 1.

In the illustrated embodiment, the two snap switches 4 and 5 are formed by completely identical elements so that also the same reference numbers are used for the elements. As shown in FIG. 2, the two snap switches are arranged next to one another in each case outside the center of the insulating plate 13 and the longitudinal center of the housing 1. In addition, they are arranged facing each other in opposing directions. The supporting surfaces 10 of the two switching rockers 9 are opposite one another at a small distance transverse to the moving direction of the switching rockers 9 and are each arranged eccentrically with respect to the longitudinal center line of the working piston 3. Because of their facing arrangement, the two switching rockers 9 of the two snap switchings 4 and 5 respectively move up and down in the same parallel linear directions and opposite rotational directions when the working piston is moved up or down. The supporting surfaces, in this case, carry out sliding motions on the top side of the working piston 3 that move in the same rotating direction with respect to the longitudinal center line of the working piston 3. The working piston 3 will thus rotate.

As shown in FIG. 2, the switching rockers 9 are asymmetrical, such that the supporting surfaces 10 are closer to the longitudinal center line of the working piston 3 than the recess 11 with which the switching rockers 9 are fitted onto the holding plates 8 that are also located at a larger radial distance than the surfaces 10. Because of this asymmetrical development, it is possible to use a working piston 3 with a relatively small head. Despite the asymmetricality of the switching rockers 9, different structural shapes are not required for the switching rockers 9 due to the facing arrangement of the snap switches 4 and 5.

If the snap switches 4 and 5 are constructed identically and are arranged identically, their switching processes take place in the same position of the working piston 3, i.e., at the same switching temperature. It is contemplated to introduce different switching points and thus switching temperatures for the two snap switches, by constructing one or several of the elements differently or arranging them differently. For example, it is contemplated to change the position of the support of the switching tongue 6 of one of the switches 4 or 5 at the holding plate so that the snap effect is achieved with a correspondingly changed position of the switching rocker 9. In a similar way, it is also contemplated to slightly bend the switching rocker 9. Alternatively, in a further contemplated embodiment, the position of the home contact 21 is changed to provide a different switching point.

Although the present invention has been described and illustrated in detail, it is to be clearly understood that the same is by way of illustration and example only and is not to be taken by way of limitation. The spirit and scope of the invention are to be limited only by the terms of the appended claims.

What is claimed is:

1. An electrical switchgear having a common housing for a thermostatic expansion material element and at least two electrical snap switches that are actuated by a working piston of the expansion material element, said snap switches containing a switching tongue that swivels between two switching positions and to which a switching spring means is applied, the other end of said spring means being coupled to a switching rocker that is swivelled by said working piston and is disposed on a holding plate, wherein said snap switches are electrically separated from one another and each have their own holding plate and their own switching rocker, said switching rockers being arranged eccentrically to the longitudinal axis of said working piston in the housing and extending essentially parallel to one another.

2. A switchgear according to claim 1, wherein the snap switches each include receiving means for connecting and connecting said switching rocker to said holding plate wherein the switching rockers have a supporting surface contacting the working piston, said supporting surface being arranged closer to the longitudinal center line of the working piston than said connecting means.

3. A switchgear according to claim 2, wherein the snap switches are rotatably arranged by 180° with respect to one another such that the switching rockers move in opposing rotational directions.

4. A switchgear according to claim 3, wherein the snap switches are composed of identical elements.

5. A switchgear according to claims 3, wherein at least one of the switching tongues, switching rockers and the coupling points for the switching springs of one of the two snap switches are different from the other of the two snap switches.

6. A switchgear according to claim 5, wherein the arrangement of the switching tongues, the switching rockers and the coupling points of the switching springs in one of the two snap switches are different from the other of the two snap switches.

7. A switchgear according to claim 3, wherein the arrangement of the switching tongues, the switching rockers and the coupling points of the switching springs in one of the two snap switches are different from the other of the two snap switches.

8. An electrical switchgear having a common housing for a thermostatic expansion material, and a working piston displaceable by said expansion material, comprising:

electrically separate snap switches;

each of said switches having individual actuation rockers disposed on a holding plate for switching said snap switches, said rockers being moved and controlled by displacement of said working piston; and wherein said rockers move in said housing in substantially parallel moving paths, wherein said paths are on opposite sides of a longitudinal center of said working piston and are parallel to said longitudinal center.

9. An electrical switchgear according to claim 8, wherein said paths are in opposite rotational directions.

10. An electrical switchgear according to claim 9, wherein one said snap switch is arranged diametrically opposed with respect to another said snap switch.

11. An electrical switchgear according to claim 9, wherein said piston rotates in a single direction produced by the rotation of said rockers in opposite parallel directions.

12. An electrical switchgear according to claim 8, wherein the switches have identical constructions.

13. An electrical switchgear according to claim 8, wherein each of said actuation rockers has a contact surface which contacts said working piston and is arranged such that said contact surface is radially closer to a centerline of said working piston than is a centerline of said switch.

* * * * *